US010782108B1

(12) United States Patent
Morris

(10) Patent No.: US 10,782,108 B1
(45) **Date of Patent: *Sep. 22, 2020**

(54) MORRIS 80 PLASTIC SHARK FLETCH UNIT

(71) Applicant: Elgie A Morris, Grants Pass, OR (US)

(72) Inventor: Elgie A Morris, Grants Pass, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/356,422

(22) Filed: Mar. 18, 2019

(51) Int. Cl.
*F42B 6/06* (2006.01)
*F42B 10/04* (2006.01)

(52) U.S. Cl.
CPC ..... *F42B 6/06* (2013.01); *F42B 10/04* (2013.01)

(58) Field of Classification Search
CPC ..... F42B 6/04; F42B 6/06; F42B 6/08
See application file for complete search history.

(56) References Cited

U.S. PATENT DOCUMENTS 3,031,797 A * 5/1962 Gelfand ..... A63H 27/14 446/65
3,106,400 A * 10/1963 Zwickey ..... F42B 6/06 473/586
3,756,602 A * 9/1973 Carella ..... F42B 6/06 473/586
3,846,878 A * 11/1974 Monson ..... F42B 6/04 86/51
3,851,590 A * 12/1974 LaCosta ..... F42B 6/04 102/501
3,853,320 A * 12/1974 Carella ..... F42B 6/06 473/586
3,861,314 A * 1/1975 Barr ..... F42B 6/04 102/501
4,003,576 A * 1/1977 Carella ..... F42B 6/06 473/586
4,182,513 A * 1/1980 Henderson ..... F42B 6/04 124/24.1
4,696,281 A * 9/1987 Nishioka ..... F42B 6/00 124/25
6,695,727 B1 * 2/2004 Kuhn ..... F42B 6/06 473/586
8,157,680 B2 * 4/2012 Anderson ..... F42B 6/04 473/578
8,764,589 B1 * 7/2014 Thompson ..... F42B 6/04 473/578

(Continued)

*Primary Examiner* — John A Ricci

(57) ABSTRACT

When combined with a variety of shafts of various lengths, this unit will create pistol crossbow bolts, crossbow bolts and archery arrows of various sizes used for recreational shooting, competition shooting, small game hunting and archery fishing. These bolts or arrows can be use with pistol crossbows, crossbows and archery bows or any other device used to project said projectiles. This seven and one half inch fletch unit is a solid one piece unit made of a strong but, light weight plastic compound. It has a NOCK to hold the bow string in place. It has two FLAT WINGS and a stabilizing TAIL which creates an accurate and stable bolt or arrow flight. No other fletch unit has flat wings with a tail. These features allow the bolt or arrow to be easily viewed in flight. This also allows this bolt or arrow to be used for competition shooting because these projectiles can be easily located, scored and then retrieved from any type competition target. This Morris 80 PLASTIC SHARK FLETCH UNIT has a smoothed dowel shaped end to accept almost any type of tubular shaft used for creating bolts or arrows.

1 Claim, 6 Drawing Sheets

A tubular shaft with point slides over the dowel shaped shaft of the plastic fletch unit creating a pistol crossbow bolt, a crossbow bolt or an archery arrow, depending the length of the tublar shaft.

(56) References Cited

U.S. PATENT DOCUMENTS

| | | | | |
|---|---|---|---|---|
| 10,209,043 | B2 * | 2/2019 | Morris | F42B 6/06 |
| 2013/0123051 | A1 * | 5/2013 | Pierce | F42B 6/08 473/577 |

* cited by examiner

VIEW FROM TOP

VIEW FROM SIDE

VIEW FROM END

A tubular shaft with point slides over the dowel shaped shaft of the plastic fletch unit creating a pistol crossbow bolt, a crossbow bolt or an archery arrow, depending the length of the tublar shaft.

MORRIS 80 PLASTIC SHARK FLETCH UNIT

RELATED APPLICATIONS

Provisional Application 62/398,916
Filing Date: Sep. 22, 2016

STATEMENT REGARDED FEDERALLY SPONSORED RESEARCH

Not Applicable

NAMES OF PARTIES IN JOINT RESEARCH AGREEMENT

Not Applicable

INCORPORATION-BY-REFERENCE OF MATERIAL

Not Applicable

STATEMENT REGARDING PRIOR DISCLOSURES BY INVENTOR OR JOINT INVENTOR

Not Applicable

BACKGROUND

This plastic fletch unit is designed to create pistol crossbow bolts, crossbow bolts and archery arrows. It is seven and one half inches in length with a smooth dowel shaped end to accept a variety of tubular shafts creating pistol crossbow bolts crossbow bolts and archery arrows. Total length of the bolt or arrow will depend on the length of any shaft used. This new fletch unit solves many problems often found with the common bolt an arrows using feathers as fletches.

The commonly used pistol crossbow bolts, crossbow bolts and arrows use feather for fletches. Those fletches continually wear out or, become dismembered from the shafts forcing the user to continually replace the fletches. This newly created plastic fletch unit will never wear out or become dismembered from the shaft as, it is made of a solid piece of molded plastic with nylon reinforcement. The MORRIS 80 PLASTIC SHARK FLETCH UNIT solves those problems.

SUMMARY

A plastic fletch unit created by injection mold. Fletch unit composition is durable plastic with nylon reinforcement. Fletch unit is seven and one half inches in length. Fletch unit is designed with two wings to stabilize bolt elevation and a tail to stabilize directional flight. Fletch unit has a smooth dowel shaped tip designed to accept tubular shaped materials such as aluminum, fiberglass or carbon fiber to create pistol crossbow bolts, crossbow bolts and archery arrows of various lengths for target shooting, recreational shooting or hunting. No other fletch unit is designed with two wings and a tail and, uses this variety of materials to create bolts or arrows. This plastic fletch unit with its unique length, unique design and versatility in bolt and arrow usage, is designed to totally change and enhance the way any pistol crossbow bolt, standard crossbow bolt or archery arrow is created and used.

DETAILED DESCRIPTION OF THE INVENTION

Figure 1:
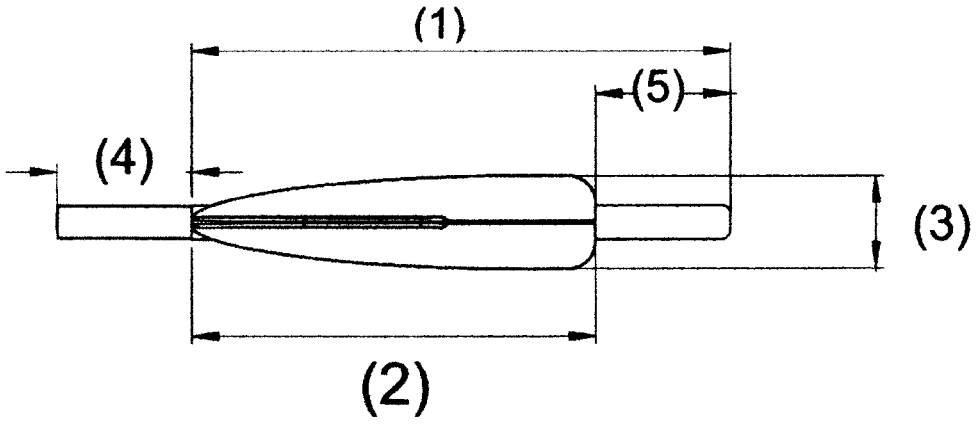
FIG. 1 shows the plastic fletch unit of the present invention viewed from above.
Figure 2:
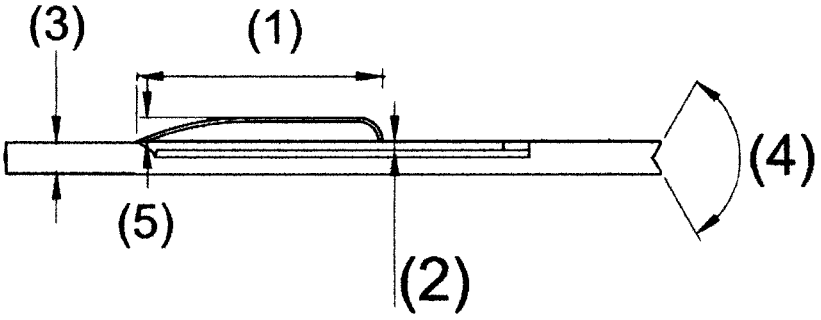
FIG. 2 shows the plastic fletch unit of the present invention viewed from side.
Figure 3:
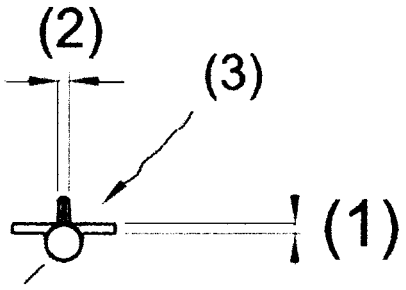
FIG. 3 shows the plastic fletch unit of the present invention viewed from tip end.

This plastic fletch unit is made of a solid durable light weight plastic with nylon reinforcement created in an injection mold. As shown in FIG. 1, this unit 1 is seven and one half inches in length. This unit includes two flat wings (2) and a one inch dowel shaped shaft (4) to receive a variety of tubular metal, fiberglass or carbon fiber shafts. Each wing (3) is tapered from five-sixteenths of an inch width down to approximately one-sixteenth of an inch width starting three-quarters of an inch from the nock end (5) down the length of the five inch wing. As shown in FIG. 2, the tail (1) is three and one half inches long and (5) three-sixteenths of an inch tall and tapered down on each end. The unit shaft (3) is five-sixteenths of an inch in diameter and dowel shaped on one end and a nock (4) on the other end. Each of the two side wings are flat (3) and level with the top of the shaft. Each wing (1) is one-sixteenth of an inch thick. The tail (2) is one-sixteenth of an inch thick (FIG. 3).

Figure 4:
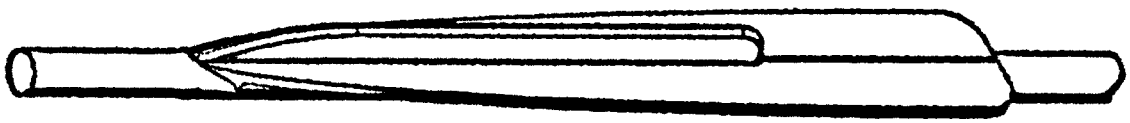
FIG. 4 shows a three dimensional view of the plastic fletch unit of the present invention.
Figure 5:
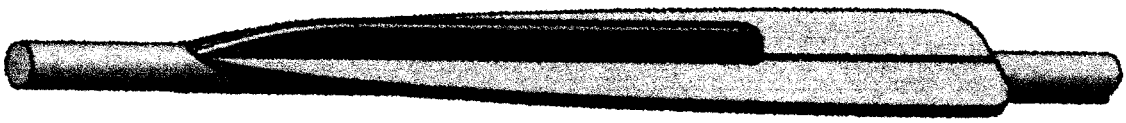
FIG. 5 shows a line drawn view of the plastic fletch unit of the present invention.
Figure 6:
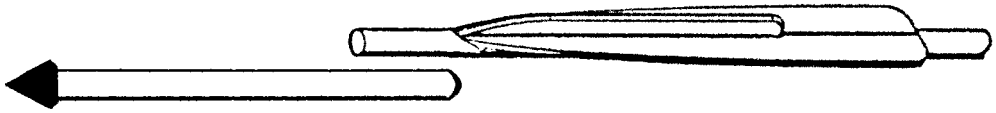
FIG. 6 shows a line drawn view of the plastic fletch unit of the present invention in relation to an arrow shaft.

FIG. 4 shows a three dimensional view of this plastic fletch unit. FIG. 5 shows a three dimensional line drawing of this plastic fletch unit. This fletch unit, when fitted with a metal, fiberglass or carbon fiber tubular shaft of various lengths, is designed to create various pistol crossbow bolts, crossbow bolts and archery arrows of various lengths for various purposes (FIG. 6).

The invention claimed is:

1. A plastic fletch unit designed to be combined with a variety of shafts to create pistol crossbow bolts, crossbow bolts and archery arrows of various sizes for use with pistol crossbows, crossbows and archery bows or any other device used to project projectiles, which comprises: a fletch unit comprising a solid one piece injection molded plastic unit having a length of approximately seven and one half inches with a nock on a first end which is configured to securely hold a string of a pistol crossbow, crossbow or archery bow: two flat wings level with an upper surface of the fletch unit to control elevation during bolt or arrow flight; a single stabilizing tail projecting upward from said upper surface along a diametrical line of the shaft to stabilize vertical flight; and a smooth dowel shape on a second end configured to accommodate a variety of shafts of various materials including aluminum, fiberglass and carbon fiber tubing creating pistol crossbow bolts, crossbow bolts or archery arrows.

* * * * *